US011873596B2

(12) United States Patent
Katkar et al.

(10) Patent No.: US 11,873,596 B2
(45) Date of Patent: Jan. 16, 2024

(54) PEDESTAL ASSEMBLIES FOR LAUNDRY APPLIANCES

(71) Applicant: WHIRLPOOL CORPORATION, Benton Harbor, MI (US)

(72) Inventors: Mansi Gajanan Katkar, Pune (IN); Omkar Sunil Mithari, Pune (IN); Shrinivas V. Pawar, Hubli (IN); Mohit Akhilesh Singh, Mumbai (IN); Vivek Singh, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 197 days.

(21) Appl. No.: 17/466,562

(22) Filed: Sep. 3, 2021

(65) Prior Publication Data

US 2023/0076023 A1 Mar. 9, 2023

(51) Int. Cl.

| | |
|---|---|
| ***D06F 31/00*** | (2006.01) |
| ***D06F 39/08*** | (2006.01) |
| ***D06F 39/12*** | (2006.01) |
| ***A47L 23/00*** | (2006.01) |
| *D06F 13/00* | (2006.01) |

(52) U.S. Cl.

CPC ..... *D06F 31/00* (2013.01); *D06F 39/083* (2013.01); *D06F 39/088* (2013.01); *A47L 23/00* (2013.01); *D06F 13/00* (2013.01); *D06F 39/125* (2013.01)

(58) Field of Classification Search

CPC ..... D06F 13/00; D06F 31/00; D06F 39/083; D06F 39/088; A47L 23/00

See application file for complete search history.

(56) References Cited

U.S. PATENT DOCUMENTS

| | | | | |
|---|---|---|---|---|
| 5,418,996 | A * | 5/1995 | Chen | A47L 23/02 15/36 |
| 8,234,889 | B2 | 8/2012 | Kim et al. | |
| 8,266,930 | B2 | 9/2012 | Jeong et al. | |
| 10,385,494 | B2 | 8/2019 | Sim et al. | |
| 10,570,547 | B2 | 2/2020 | Lee | |
| 2002/0152566 | A1 * | 10/2002 | Nappi, Sr. | A47L 23/02 15/36 |

(Continued)

FOREIGN PATENT DOCUMENTS

| | | |
|---|---|---|
| CN | 106691356 A | 5/2017 |
| CN | 104250906 B | 4/2019 |

(Continued)

OTHER PUBLICATIONS

Electronic translation of CN-111394945-A. (Year: 2020).*
Electronic translation of CN-111265176-A. (Year: 2020).*

*Primary Examiner* — Joseph L. Perrin
(74) *Attorney, Agent, or Firm* — Brooks Kushman, P.C.

(57) ABSTRACT

A pedestal assembly for a laundry appliance configured to operably connect to a water supply and drain of the laundry appliance arranged above the pedestal, the pedestal may include a cabinet defining a cavity configured to receive items to be laundered; and a shoe holder having at least one shaft configured to maintain at least one shoe thereon, wherein the shoe holder is configured to rotate within the cavity during a pedestal wash cycle and the shoe holder is configured to maintain a fixed position within the cavity for storage when the pedestal is not operating in a wash cycle.

16 Claims, 4 Drawing Sheets

(56) References Cited

U.S. PATENT DOCUMENTS

| | | | | |
|---|---|---|---|---|
| 2003/0196285 | A1* | 10/2003 | O | A47L 23/02 15/88.1 |
| 2018/0087197 | A1 | 3/2018 | Matos | |
| 2019/0387954 | A1 | 12/2019 | An et al. | |

FOREIGN PATENT DOCUMENTS

| | | | | |
|---|---|---|---|---|
| CN | 111265176 | A | * | 6/2020 |
| CN | 111394945 | A | * | 7/2020 |
| KR | 101405958 | B1 | | 6/2014 |
| WO | 2015143912 | A1 | | 10/2015 |
| WO | 2018040189 | A1 | | 3/2018 |

* cited by examiner

PEDESTAL ASSEMBLIES FOR LAUNDRY APPLIANCES

TECHNICAL FIELD

Aspects of the disclosure generally relate to pedestal assemblies for laundry appliances.

BACKGROUND

Pedestals are popular add on items for laundry appliances such as washers and dryers. Pedestals may provide for storage, support, leveling, etc. Users may prefer the additional height that pedestals add to the laundry appliance. Pedestals may provide storage under the laundry appliance. However, additional functions and features may be appreciated or desired.

SUMMARY

In an illustrative example, a pedestal assembly for a laundry appliance is configured to operably connect to a water supply and drain of the laundry appliance arranged above the pedestal, the pedestal may include a cabinet defining a cavity configured to receive items to be laundered; and a shoe holder having at least one shaft configured to maintain at least one shoe thereon, wherein the shoe holder is configured to rotate within the cavity during a pedestal wash cycle and the shoe holder is configured to maintain a fixed position within the cavity for storage when the pedestal is not operating in a wash cycle.

In an illustrative example, a pedestal assembly for a laundry appliance may include a cabinet defining a cavity configured to receive items, a plurality of brushes extending along a top and bottom of the cavity and movable between an extended state during a pedestal wash cycle to clean the items and a stored state when the pedestal is not operating in a wash cycle to create additional storage space within the cavity to store the items.

In an illustrative example, a pedestal assembly for a laundry appliance may include a cabinet defining a cavity configured to receive items to be laundered or stored, a shoe holder having at least one shaft configured to maintain at least one shoe thereon, and a plurality of brushes extending along a top and bottom of the cavity and movable between an extended state during a pedestal wash cycle to clean the items and a stored state when the pedestal is not operating in a wash cycle to create additional storage space within the cavity to store the items, wherein the shoe holder is configured to rotate within the cavity during the pedestal wash cycle and the shoe holder is configured to maintain a fixed position within the cavity for storage when the pedestal is not operating in a wash cycle.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like-referenced numerals designate corresponding parts throughout the different views.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Pedestals are popular add on items for many washer and dryer appliances. Pedestals may provide for storage, support, leveling, etc. Users may prefer the additional height that pedestals add to the washer or dryer appliance. However, pedestals may also provide for additional features and functions. For example, and as described herein, the pedestal may incorporate a wash cycle. The wash cycle may provide for additional washing capabilities in addition to a washing machine placed on the pedestal. The pedestal may be configured to wash or clean items that may be undesirable to place in the washing machine, such as shoes. The pedestal may provide for an automated cleaning cycle of the shoes, that helps preserve the life of the shoes, while cleaning and possibly sanitizing the shoes, separate from the washer. When not in use, the pedestal may be used a multi-unit storage cabinet. Having a dedicated washing space for shoes allows for a more hygienic washer, and a multi purpose pedestal.

The pedestal cabinet may include a shoe holder configured to hold shoes on one or more shafts. The shoes may be held on their sides and the shafts may rotate via a motor. While the shoes rotate within the cabinet, they may be scrubbed by stationary brushes arranged at the top and the bottom of the cabinet. To increase the storage space, the brushes may be placed in a stored position when the pedestal washing cycle is not in use. Thus, the pedestal described herein provides for a multi-purpose, flexible use, pedestal.

Figure 1:
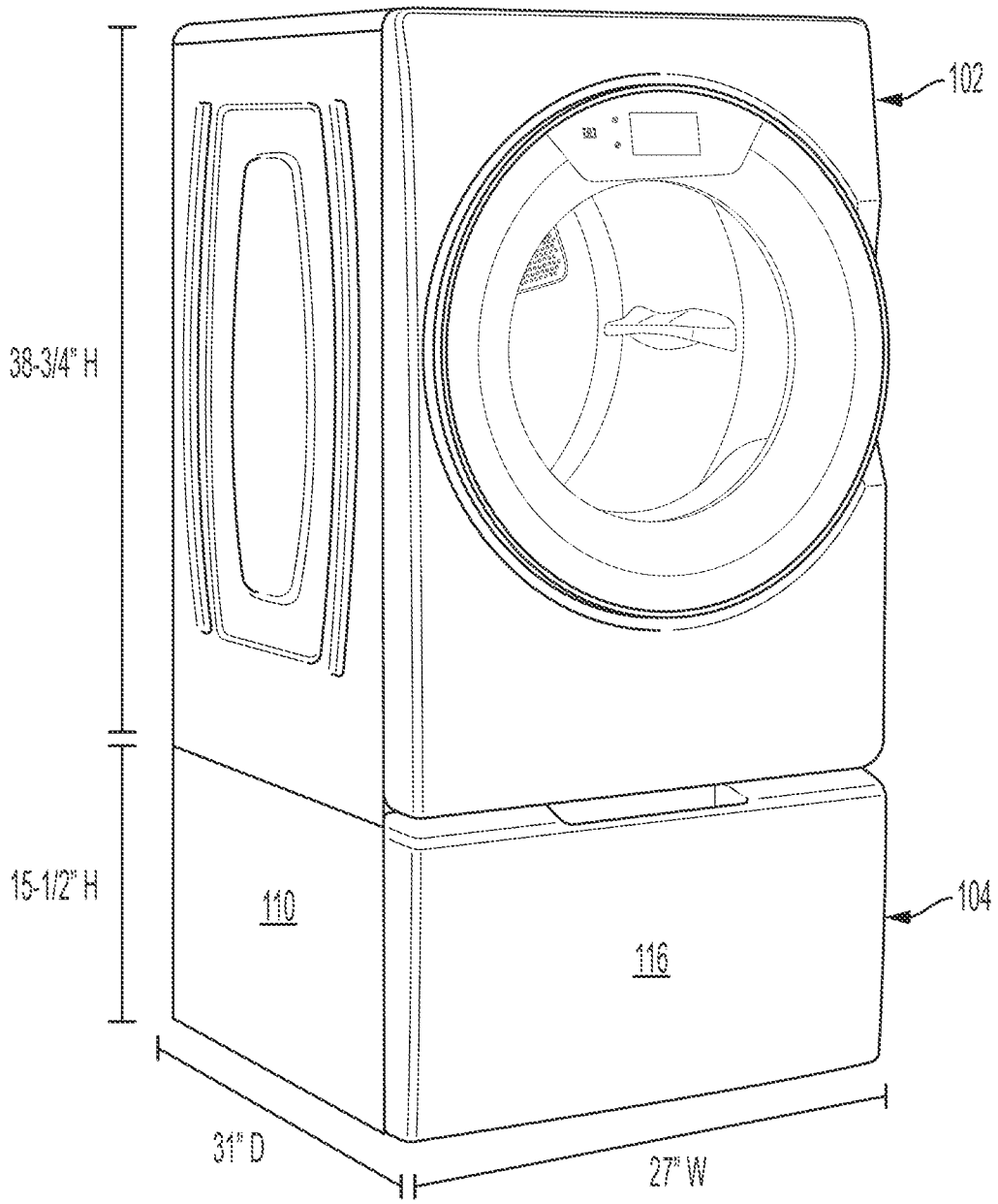
FIG. 1 illustrates a perspective view of an example laundry appliance arranged on top of a pedestal assembly.

FIG. 1 illustrates a perspective view of an example laundry appliance 102 arranged on top of a pedestal assembly 104. The laundry appliance 102 may be a washer for washing laundry, a dryer for drying articles of laundry, or a combination washer and dryer. Other appliances may also be considered. The pedestal assembly 104 may be a cabinet or support configured to maintain the laundry appliance 102 thereon. The pedestal assembly 104 may have a similar width and depth as that of the laundry appliance 102 that it is supporting. The laundry appliance 102 may be secured to the pedestal assembly 104 via various types of attachment mechanisms. Mostly, a set of feet extending from the laundry appliance 102 may be secured to the pedestal.

The pedestal assembly 104 may form a cabinet having a top and a bottom (not individually labeled in FIG. 1), a back, front 116, and two sides 110. The pedestal assembly 104 may form a hollow center configured to receive a drawer for storage of various items. The front 116 may include a drawer front with a handle for gaining access to the drawer.

Although the figures and description herein relate to appliances arranged on top of a pedestal, the concepts disclosed herein may also relate to stacking appliances on top of each other. For example, in some situations a dryer may be stacked on top of a washing machine.

Figure 2A:
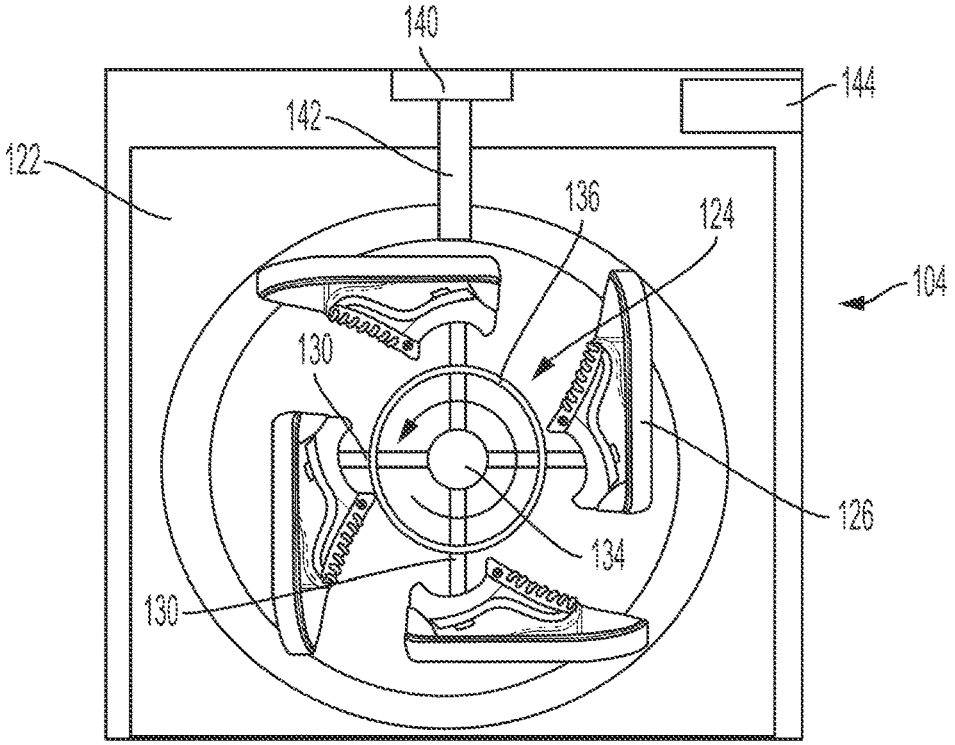
FIG. 2A illustrates an example top view of the pedestal assembly of FIG. 1 including laundered items such as shoes.
Figure 2B:
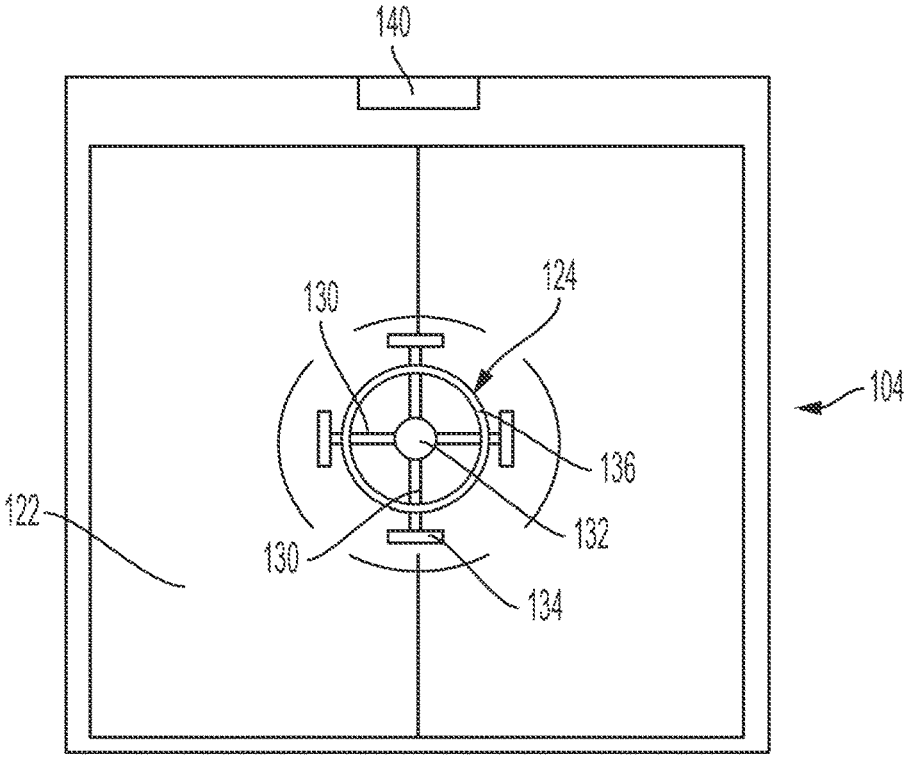
FIG. 2B illustrates an example top view of the pedestal assembly of FIG. 1 without illustrating laundered items.

FIG. 2A illustrates an example top view of the pedestal assembly 104 of FIG. 1 including laundered items, such as shoes. FIG. 2B illustrates an example top view of the pedestal assembly 104 of FIG. 1 without illustrating laundered items. As explained, the pedestal assembly 104 may define a cavity 122 which is typically configured to receive items, such as clothes, shoes, equipment, soap, etc. However, the pedestal assembly 104 may also have other functions, such as to supply a wash cycle to items within the cavity 122. The pedestal assembly 104 may include a shoe holder 124. The shoe holder 124 may be configured to hold one or more shoes 126 in a fixed relative position within the cavity 122. In one example, the shoe holder includes a plurality of shafts 130 extending from a center support 132. The shoe holder 124 may be generally arranged centrally within the cavity 122.

Each shaft 130 may include an end engagement 134 arranged at the distal end of the shaft, as best illustrated in FIG. 2B. The end engagement 134 may create a T-shaped shaft and may be configured to receive an opening of the shoe 126. The end engagement 134 may maintain the shoe 126 on the shaft 130 during a wash cycle, or generally, for storage, but also allow for easy removal. As illustrated and in one example, the shoe holder 124 may hold and wash up to four shoes 126 at a time. However, more or fewer shafts 130 may be included in the shoe holder 124, and thus the shoe holder 124 may hold more or less shoes.

The shoe holder 124 may be made of a plastic material, or may also be formed of stainless steel, or some other non-corrosive material. The material may be bacteria resistant and antimicrobial. The pedestal assembly 104 may be hermetically sealed during the pedestal wash cycle to prevent leaks, etc., but otherwise may allow for venting of air to reduce humidity within the cavity 122.

The pedestal assembly 104 includes a motor 136 configured to engage with the center support 132 of the shoe holder 124. The motor 136 may be configured to rotate the shoe holder 124 during the wash cycle. The center support 132 and thus the shafts 130, may rotate within the cavity 122. The motor 136 may be configured to rotate both clockwise and counterclockwise, and at various speeds. The motor 136 and the wash cycle may be controlled by a controller within the pedestal assembly 104. The controller may be configured to run various wash cycles, as well as dry, refresh, and sanitation cycles. The controller may control the motor, doors, drawers, water supply, temperature, etc.

The pedestal assembly 104 may define a water inlet assembly 140 configured to attach and receive a water inlet hose. This water inlet assembly 140 may receive a water inlet hose, similar to a water inlet hose used to also supply water to the laundry appliance 102 from a main water line. The water inlet assembly 140 may be fluidly connected to a feed tube 142. The feed tube 142 may deliver water or fluid to the cavity 122 during the was cycle. This is described in more detail below with respect to FIGS. 3A and 3B.

The pedestal assembly 104 may also include a drain 144. The drain 144 may be fluidly connected to the drain or drain water outlet of the laundry appliance 102. That is, instead of having a separate drain hose, the pedestal assembly 104 may connect to the drain of the washing machine and grey water may be drained via the washing machine drain hose, instead of having a separate drain hose for the pedestal assembly 104.

As explained, the pedestal assembly 104 may be used as a storage cabinet when the pedestal assembly 104 is not operating a wash cycle. Items other than shoes may also be stored in the pedestal. During a storage, the shoe holder 124 may remain fixed within the cavity 122. Additionally or alternatively, the shoe holder 124 may be selectively removable from the cavity 122 to allow for more storage. As illustrated in FIG. 2B, by removing the shoes, the cavity 122 may allow for more storage room.

Figure 3A:
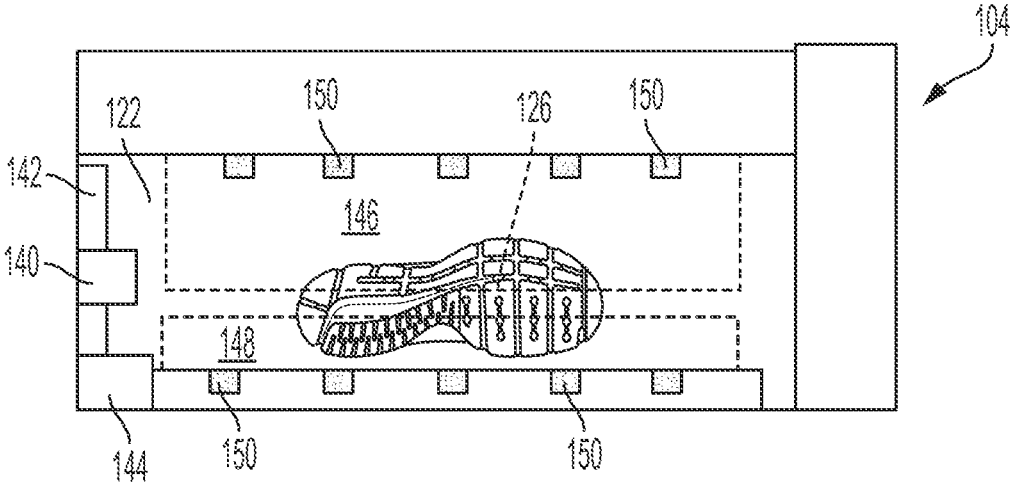
FIG. 3A illustrates an example side view of the pedestal assembly of FIG. 2A including laundered items such as shoes, with at least one brush assembly in an extended position.
Figure 3B:
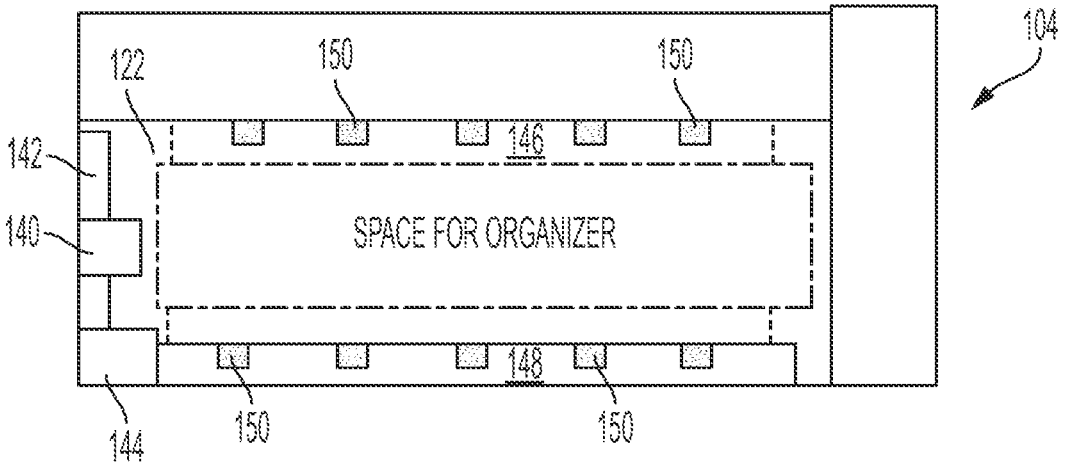
FIG. 3B illustrates an example side view of the pedestal assembly of FIG. 2B without illustrating the laundered items, and with the at least one brush assembly in a stored position.

FIG. 3A illustrates an example side view of the pedestal assembly 104 of FIG. 2A including laundered items such as shoes, with at least one brush assembly in an extended position. FIG. 3B illustrates an example side view of the pedestal assembly 104 of FIG. 2B without illustrating the laundered items, and with the at least one brush assembly in a stored position. The pedestal assembly 104 may include at least one brush assembly having a least one brush. In the examples described herein, the pedestal assembly 104 includes a first brush assembly 146 arranged at the top of the pedestal, and a second brush assembly 148 arranged at the bottom of the pedestal. The brush assemblies 146, 148 may be configured to apply bristles from the brushes to the shoe 126 during washing. When the motor 136 rotates the shoe holder 124, thus rotating the shoes 126, the shoes 126 move along and between the brush assemblies 146, 148. Thus, the brush assemblies 146, 148, while stationary, move relative to the shoe 126 to clean the shoe 126. The brush assembly 146, 148 may sufficiently but gently clean the shoe 126. The brush assemblies 146, 148 are described in more detail with respect to FIG. 4.

The water inlet assembly 140 may supply water to the cavity 122 during the pedestal wash cycle. The water inlet assembly 140 may include at least one water inlet 150 configured to allow water to spray into the cavity 122. In the example illustrated, a plurality of water inlets 150 are arranged throughout the cavity 122. The water inlets 150 may be spaced along the top and bottom of the cavity and may provide fluid at or near the brush assemblies 146, 148. Thus, during the wash cycle, water may be equally, or near equally supplied throughout the cavity 122 to ensure a more effective wash.

FIG. 3A illustrates the brush assemblies 146, 148 in an extended position. During the pedestal wash cycle, the brush assemblies 146, 148 may be extended so as to ensure that the brushes of the assemblies 146, 148 come into contact with the shoe 126. However, when the pedestal assembly 104 is not operating in the wash cycle, it may be desirable to have more storage, and for the brushes of the assemblies 146, 148 to be less obtrusive to the cavity 122. Thus, in a storage state, the brush assemblies 146, 148 may be retracted, or stored, as illustrated in FIG. 3B. This allows for more space for storage, lower likelihood that an item being stored comes into contact with the brushes, etc.

Figure 4:
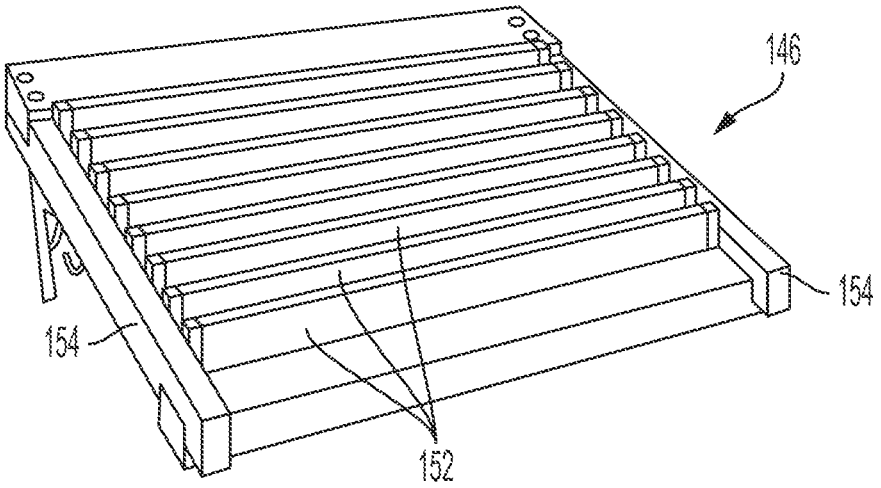
FIG. 4 illustrates an example brush assembly as illustrated in FIGS. 3A and 3B.
Figure 5A:
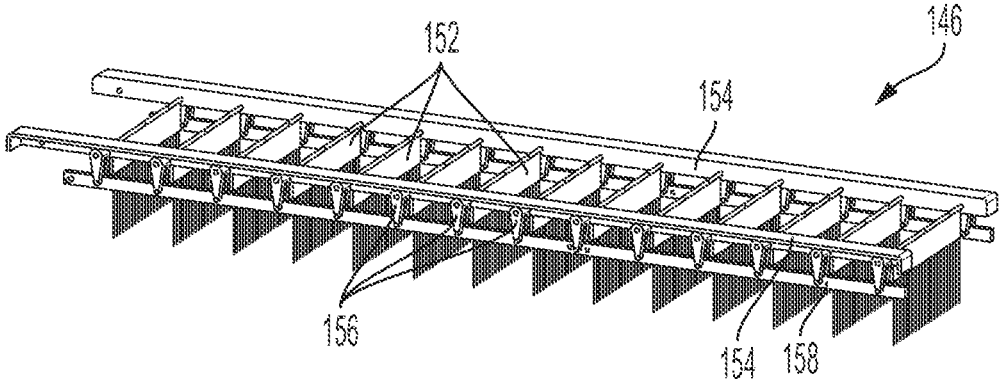
FIG. 5A illustrates an example perspective view of the brush assembly in an extended position.
Figure 5B:
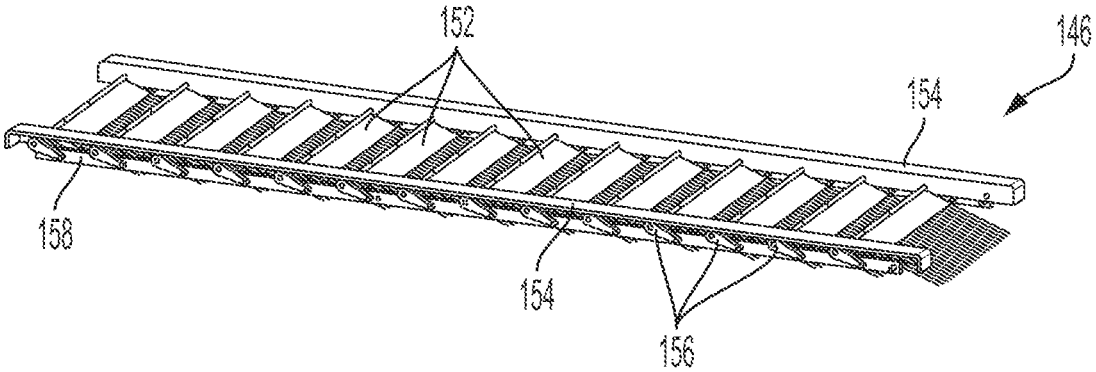
FIG. 5B illustrates an example perspective view of the brush assembly in a stored position.

FIG. 4 illustrates an example brush assembly 146 as illustrated in FIGS. 3A and 3B. FIG. 5A illustrates an example perspective view of the brush assembly 146 in an extended position, and FIG. 5B illustrates an example perspective view of the brush assembly 146 in a stored position.

The brush assembly may be either one of the first brush assembly 146 or second brush assembly 148. For simplicity, the brush assemblies in FIG. 4, FIG. 5A, and FIG. 5B are referred to as the first brush assembly 146, but is understood to be germane to both assemblies. The brush assembly 146 may include a plurality of brushes 152, each arranged in spaced rows extending between two parallel support rails 154. The brushes 152, as explained, may include a plurality of bristles configured to provide cleaning capabilities for the shoe 126.

The brushes 152 may extend from rods and may be pivotable at each side at the support rails 154. FIG. 4 illustrates the brushes 152 in a first, or extended position. In this position, which is the typical brush position during the pedestal wash cycle, the brushes 152 face away from the top of the pedestal into the cavity. Because the brushes 152 are spaced, water from the water inlets 150 may be sprayed on and between the brushes.

The brushes 152 may then move, via pivot supports 156 on the support rails 154, to a second, or stored position, when the pedestal assembly 104 is not operating in the pedestal wash cycle. This is best illustrated in FIG. 5B. The brushes 152 may be spaced from each other such that when the brushes are in the stored position, the brushes 152 may form a flat surface, closing the spaces between the brushes 152 that occur when the brushes are in the extended position.

The brushes 152 may be moved by a brush motor (not illustrated) that controls a brush rod 158. The brush rod 158 may be a lever attached to each pivot points 156 and may move laterally to adjust the pivot point 156 and thus the position of the brushes 152. For example, the rod 158 may be moved from a first position away from the support rails 154, as illustrated in FIG. 5A. In this position the rod 158 forces the brushes 152 downward by pulling the pivot point 156 downward. The rod 158 may then be positioned along the support rails 154, thus angling the pivot points 156 and thus angling the brushes 152 in the stored position, as illustrated in FIG. 5B. The motor and/or the rod 158 may be controlled by the controller that controls the rotation of the shoe holder 124 or other components of the pedestal assembly 104. In the collapsed state, the brushes 152 may save approximately 66% of space compared to when the brushes 152 are in the extended state.

While the brushes 152 are illustrated as forming spaced rows, the brushes 152 may also be arranged in various configurations, such as forming a cylindrical shape. The brushes 152 may each have varying stiffnesses, widths, depths, etc., to facilitate various exposure to the shoe. Further, while the examples shown is discussed herein discuss shoes, other items may be cleaned by the pedestal assembly 104, including but not limited to athletic shoes such as cleats, skates, slippers, and equipment such as helmets, hats, gloves, etc.

The pedestal assembly 104 may include a drying mechanism such as a silica gel dehumidifier. The drying mechanism may reduce humidity in the cavity 122 following completion of the pedestal wash cycle. The pedestal assembly 104 may also include fans, blowers, heaters, and other mechanisms to aid in drying and sanitizing the cavity 122 and its contents. Once the pedestal wash cycle is completed, the shoe 126 may be removed from the cavity 122. An additional cleaning cycle may be implemented to further clean and sanitize the pedestal to prepare the pedestal for functioning as a storage cabinet.

Accordingly, disclosed herein is a pedestal assembly 104 that allows for multi-function multi-feature use, such as storage, and a pedestal wash cycle. The assembly may define a cavity that includes a shoe holder configured to hold and rotate shoes within the cavity. During rotation, the shoe may come into contact with brushes arranged on the top and bottom of the pedestal. The brushes may sufficiently but gently clean the shoe. After the wash cycle has concluded, the brushes may be retracted so that the pedestal may act as a storage cabinet.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A pedestal assembly for a laundry appliance configured to operably connect to a water supply and drain of the laundry appliance arranged above the pedestal assembly and supply a wash cycle to items within the pedestal assembly, the pedestal assembly comprising:

a cabinet defining a cavity configured to receive items to be laundered; and a shoe holder having at least one shaft configured to maintain at least one shoe thereon, wherein the shoe holder is configured to rotate within the cavity during a wash cycle and the shoe holder is configured to maintain a fixed position within the cavity for storage when the pedestal assembly is not operating in the pedestal wash cycle, and a plurality of brushes arranged along a top and bottom of the cavity and selectably extending into the cavity and movable between an extended position during the pedestal wash cycle and a stored position when the pedestal assembly is not operating in the wash cycle to create additional storage space within the cavity, wherein the brushes include a plurality of brushes arranged in spaced rows extending between two parallel support rails, the brushes pivotable at the support rails between the extended position and stored position.

2. The pedestal assembly of claim 1, wherein the at least one shaft includes a plurality of shafts each configured to maintain a shoe thereon.

3. The pedestal assembly of claim 2, wherein the plurality of shafts extend radially outwardly from a center support.

4. The pedestal assembly of claim 3, further comprising a motor configured to rotate the center support to rotate the shafts and shoes thereon during the pedestal wash cycle.

5. The pedestal assembly of claim 1, further comprising a water inlet configured to supply fluid to the cavity from a water supply during the pedestal wash cycle.

6. The pedestal assembly of claim 1, further comprising a drain configured to connect to a water outlet of the laundry appliance.

7. A pedestal assembly for a laundry appliance, comprising:

a cabinet defining a cavity configured to receive items; and a plurality of brushes arranged along a top and bottom of the cavity and selectively extending into the cavity and movable between an extended position during a pedestal wash cycle to contact and clean the items and a stored position when the pedestal assembly is not operating in the wash cycle to create additional storage space within the cavity to store the items, wherein the brushes include a plurality of brushes arranged in spaced rows extending between two parallel support rails, the brushes pivotable at the support rails between the extended position and stored position.

8. The pedestal assembly of claim 7, further comprising a plurality of water inlets arranged along the top and bottom of the cavity to provide fluid to the cavity during the pedestal wash cycle.

9. The pedestal assembly of claim 7, further comprising a shoe holder arranged within the cabinet and having at least one shaft configured to maintain at least one shoe thereon.

10. The pedestal assembly of claim 9, wherein the shoe holder is configured to rotate within the cavity during the pedestal wash cycle such that the shoe engages with at least one of the brushes during the wash cycle, and the shoe holder is configured to maintain a fixed position within the cavity for storage when the pedestal assembly is not operating in the wash cycle.

11. The pedestal assembly of claim 10, wherein the at least one shaft includes a plurality of shafts each configured to maintain a shoe thereon.

12. The pedestal assembly of claim 11, wherein the plurality of shafts extend radially outwardly from a center support.

13. The pedestal assembly of claim 12, further comprising a motor configured to rotate the center support to rotate the shafts and shoes thereon during the pedestal wash cycle.

14. The pedestal assembly of claim 12, wherein the plurality of shafts extend radially outwardly from the center support.

15. The pedestal assembly of claim 7, further comprising a water inlet to provide fluid to the cavity and a drain configured to connect to a water outlet of the laundry appliance.

16. A pedestal assembly for a laundry appliance including components to provide a wash cycle to items within the pedestal assembly, comprising:

a cabinet defining a cavity configured to receive items to be laundered or stored;

a shoe holder having at least one shaft configured to maintain at least one shoe thereon; and a plurality of brushes arranged along a top and bottom of the cavity and selectively extending into the cavity and movable between an extended position during a wash cycle to contact and clean the items and a stored position when the pedestal assembly is not operating in the wash cycle to create additional storage space within the cavity to store the items, wherein the shoe holder is configured to rotate within the cavity during the pedestal wash cycle and the shoe holder is configured to maintain a fixed position within the cavity for storage when the pedestal assembly is not operating in the wash cycle, wherein the brushes are arranged in spaced rows extending between two parallel support rails, the brushes pivotable at the support rails between the extended position and stored position.

* * * * *